United States Patent [19]

Simpson et al.

[11] Patent Number: 5,074,102

[45] Date of Patent: Dec. 24, 1991

[54] FLAT TRACK MODIFIED SOFT SHELL CAPSULE FILLING MACHINE

[75] Inventors: Wallington M. Simpson, Waldwick, N.J.; Joseph F. Schlosser, Chester, N.Y.

[73] Assignee: American Cyanamid Company, Wayne, N.J.

[21] Appl. No.: 589,624

[22] Filed: Oct. 1, 1990

Related U.S. Application Data

[63] Continuation-in-part of Ser. No. 429,258, Oct. 26, 1989, abandoned.

[51] Int. Cl.[5] ..... B65B 47/10; B65B 47/02

[52] U.S. Cl. ..... 53/454; 53/140; 53/560; 141/5; 141/8; 141/144

[58] Field of Search ..... 53/559, 560, 900, 453, 53/454, 140, 266 R; 141/5, 7, 8, 67, 144, 163

[56] References Cited

U.S. PATENT DOCUMENTS

| | | | |
|---|---|---|---|
| 2,275,267 | 12/1956 | Stirn et al. | 141/1 |
| 2,597,986 | 5/1952 | Halstead | 53/560 X |
| 2,663,128 | 12/1953 | Stirn et al. | 53/560 X |
| 2,690,038 | 9/1954 | Stirn et al. | 53/560 |
| 2,697,317 | 12/1954 | Stirn et al. | 53/560 |
| 2,878,630 | 3/1959 | Stirn et al. | 53/560 |
| 3,038,282 | 6/1962 | Hansen et al. | 53/454 |
| 3,046,605 | 7/1962 | Greif et al. | 18/47.5 |
| 3,126,681 | 3/1964 | Cloud et al. | 53/559 X |
| 3,203,347 | 8/1965 | Hansen et al. | 101/219 |
| 3,269,088 | 8/1966 | Kath | 53/560 |
| 3,557,517 | 1/1971 | Limmer | 53/559 X |
| 3,626,655 | 12/1971 | Eitel | 53/559 X |
| 3,815,322 | 6/1974 | Wyslotsky | 53/559 X |
| 4,325,761 | 4/1982 | Pace | 156/69 |
| 4,403,461 | 9/1983 | Goutard et al. | 53/282 |
| 4,555,894 | 12/1985 | Illy | 53/559 X |
| 4,591,475 | 5/1986 | Tomka et al. | 264/328 |
| 4,609,403 | 9/1986 | Wittwer et al. | 106/122 |
| 4,655,027 | 4/1987 | Chasman | 53/140 |
| 4,747,250 | 5/1988 | Rossi | 53/559 X |
| 4,817,367 | 4/1989 | Ishikawa et al. | 53/454 |
| 4,820,364 | 4/1989 | Graham | 156/69 |

*Primary Examiner*—Horace M. Culver
*Attorney, Agent, or Firm*—Kenneth J. Dow

[57] ABSTRACT

This invention relates to a method and apparatus for filling a powder, lipid or granule into a soft shell capsule employing a flat linked track of cavity blocks to prevent spillage.

12 Claims, 7 Drawing Sheets

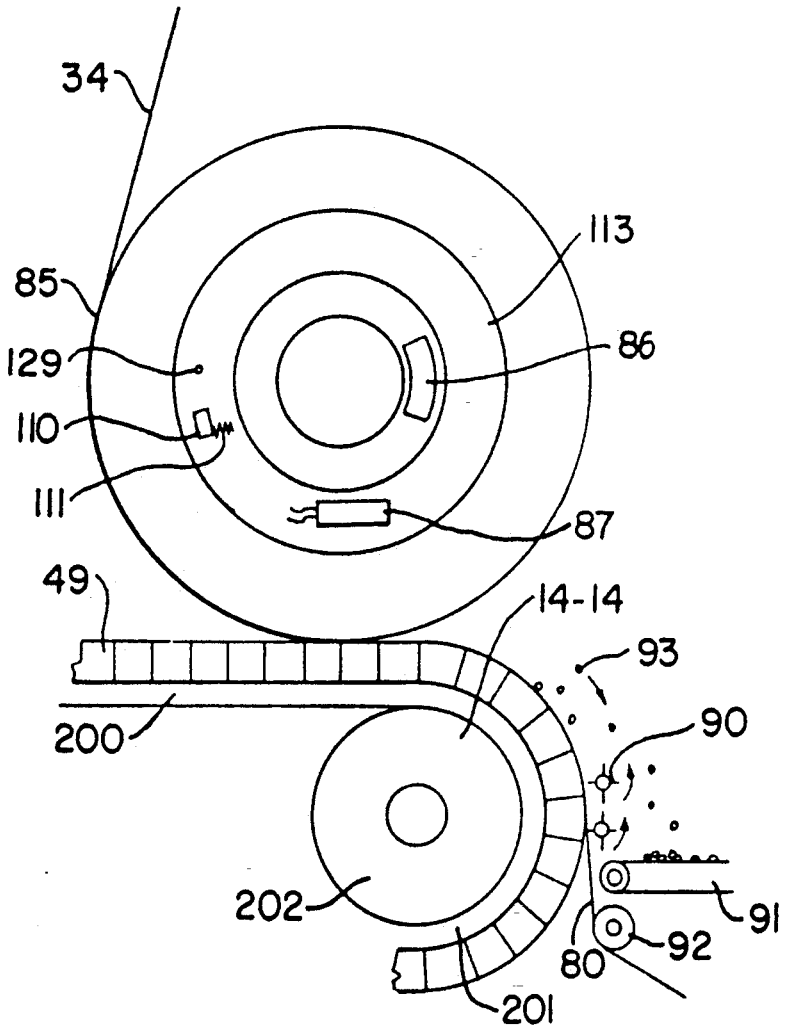
F. I G. 10

FLAT TRACK MODIFIED SOFT SHELL CAPSULE FILLING MACHINE

CROSS SECTION TO RELATED APPLICATION

This application is a continuation-in-part of commonly assigned application, Ser. No. 07/429,253, filed Oct. 26, 1989, now abandoned.

The present invention relates to a method and apparatus for filling a powder, liquid or granule into a soft shell capsule. More particularly the present invention relates to the case of a flat track in filling a powder, liquid or granule into a soft shell capsule.

BACKGROUND OF THE INVENTION

It is known that conventional soft gelatin capsules are a preferred from of administration for medicaments and similar products; especially liquids, pastes, solids dispersed in liquids, or dry solids. Soft gelatin capsules also possess particular advantages for substances which require total protection from air and light, because the gelatin is completely sealed around the contents. An important example is for the encapsulation of vitamins, which has resulted in a high degree of stability thereof.

Hard gelatin capsules are also known in the art, and are generally formed from two distinct parts, namely the "cap" and the "body", fitting one into the other so as to form the complete capsule. The cap and the body are manufactured by the same process consisting of immersing in a gelatin solution the end of a mandrel whose form corresponds to the inner volume of the cap or of the body, then withdrawing the mandrel from the solution and letting the layer of gelatin thus deposited dry, which is then removed like a glove finger. Hard shell capsules so formed have problems of leakage and do not provide adequate protection from air and light. Attempts to seal hard shell capsules have generally proven uneconomical because of the need for additional equipment and materials. See e.g., Pace, U.S. Pat. No. 4,325,761; Goutard et al., U.S. Pat. No. 4,403,461; and Graham, U.S. Pat. No. 4,820,364.

Also to be mentioned are foam soft gelatin capsules, which are formed by a homogeneous microdispersion of a gas in a mixture of dry gelatin and one or more plasticizers. Mayer et al. in U.S. Pat. No. 4,719,112 disclose forming foam capsules by dip molding. Wittwer et al. U.S. Pat. No. 4,609,403 disclose employing a reciprocating die or rotary die apparatus to form the foam soft gelatin capsules.

In general, methods for producing soft shell gelatin capsules have been performed on rotary-type apparati. Chasman et al., U.S. Pat. No. 4,655,027 disclose an apparatus for forming a sealed capsule containing a powdered pharmaceutical material therein which employs a cylindrical punch roll having a radially extending chamber and a cylindrical transfer roll for forming and filling the capsules. Ishikawa et al., U.S. Pat. No. 4,817,367 also describe an apparatus and method for manufacturing gelatin capsules. The patentees teach an apparatus comprising a gelatin sheet forming mechanism which includes a rotatable cooling drum, a gelatin capsule forming mechanism which includes a pair of die rolls, and a gelatin capsule recovery mechanism. Stirn et al. in commonly assigned U.S. Pat. No. 2,775,267 describe an apparatus comprising a casting wheel for forming the gelatin strips and a cavity die roll for forming and filling the gelatin capsules.

These devices all describe a filling mechanism located on a rotary, cylindrical or roll type apparatus. Use of such a filling mechanism has resulted in the spillage or leakage of the powder, liquid or granule substance sought to be filled into the capsule, It has now been discovered that the use of a linked track of cavity blocks to form a ribbon of gelatin into a half capsule allows the filling and sealing of the powder, liquid of granule to be carried out on a substantially horizontal plane, thereby significantly reducing product spillage and defective capsules.

SUMMARY OF THE INVENTION

According to the present invention there is provided an apparatus for producing soft plastic or gelatinous capsules filled with a powder, granule, liquid or paste composition comprising: (i) a linked track of cavity blocks, each said block comprising at least one cavity for forming said capsules; (ii) a frame or base supporting, in sequence, (a) a means for feeding a strip of soft plastic or gelatinous material onto said linked track of cavity blocks; (b) a vacuum means for causing said strip of soft plastic or gelatinous material to be pulled in tight against the walls of the capsule forming cavities; (c) a means for filling said cavities with said powder, granule, liquid or past composition; (d) a means for sealing the filled cavities with a soft plastic or gelatinous material; and (e) an ejection means for removing the sealed filled capsules from said linked track of cavity blocks; and (iii) a means for driving said linked track of cavity blocks in an elliptical fashion consecutively passed said feeding means, vacuum means, filling means, sealing means and ejection means; where said linked track of cavity blocks is on a substantially horizontal plane during the filling and sealing of the capsules.

Also, according to the present invention, there is provided an improved method for filling a flowable powder or granule composition into soft plastic or gelatin capsule shells which comprises continuously moving in an elliptical path a continuous plastic strip having a plurality of capsule shells formed therein, sealing a group of flowable powder or granular sources in a filler head block adjacent to a moving group of said capsule shells, one said source for each said shell, with said filler head block resting on said plastic strip which itself forms a resilient part of the seal until each of said shells is filled with said powder or granule composition, removing said group of capsule shells; the improvement consisting of carrying out said filling of a flowable powder or granule composition into soft plastic or gelatin capsule shells on a flat-horizontal track of linked cavity blocks whereby the amount of spilled powder or granule composition is decreased.

BRIEF DESCRIPTION OF THE DRAWINGS

FIG. 10 is an enlarged view of the sealing and ejection stages of the present invention.

DETAILED DESCRIPTION OF THE INVENTION

As used herein the term "gelatin" means gelatin and derivatives thereof. It is also understood to include other proteins similar to gelatin in physical and chemical properties and gelatin combined with starch or derivatives thereof. Gelatins are generally obtained by the partial hydrolysis of collagen derived from the skin, white connective tissues and bones of animals. Gelatin derived from an acid-treated precursor is known as type A and exhibits an isoelectric point between pH 7 and pH 9, while gelatin derived from an alkali-treated precursor is known as type B and exhibits an isoelectric point between pH 4.7 and pH 5.2. Capsules made of gelatin may be colored. See *Remington's Pharmaceutical Sciences,* Mack Publishing Co., 17th Edition, 1985, page 1298. Also contemplated by the present invention are any soft elastic capsules (SEC) which are generally described as soft, globular, gelatin shells. The gelatin is plasticized by the addition of glycerin, sorbitol, or a similar polyol. The soft gelatin is plasticized by the addition of glycerin, sorbitol, or a similar polyol. The soft gelatin shells may contain a reservative to prevent the growth of fungi. Commonly used preservatives are methyl- and propylparabens and sorbic acid. Where the suspending vehicle or solvent can be an oil, soft gelatin capsules provide a convenient and highly acceptable dosage form. The soft gelatin capsules can be prepared in a wide variety of shapes and sizes; they may be round, oval, oblong, tube or suppository shaped. Oral SEC dosage forms are generally made so that the heat seam of the gelatin shell opens to release its medication into the stomach less than five minutes after ingestion. When used as suppositories, it is the moisture present in the body cavity that causes the capsule to come apart as its heat-sealed seam and to release its contents. See *Remington's Pharmaceutical Sciences,* Mack Publishing Co., 17th Edition, 1985, page 1029.

A great variety of products may be encapsulated in soft gelatin capsules according to the present invention. Among these are medicinal compounds such as drugs or vitamins. The capsules of the present invention may also be employed in food packaging, such as for powdered instant coffee or spices; candy manufacturing; fertilization of ornamental plants and/or indoor plants; packing of sensitive seeds in combination with protective agents and/or fertilizers; and packing of single dyestuffs or mixtures of various drugs. Capsules provide a convenient vehicle however small, accurately determined quantities of material are desired. It is contemplated herein to fill the capsules with a powder, granule, liquid or paste composition or even possibly a combination of such compositions.

DESCRIPTION OF THE PREFERRED EMBODIMENTS

Figure 1:
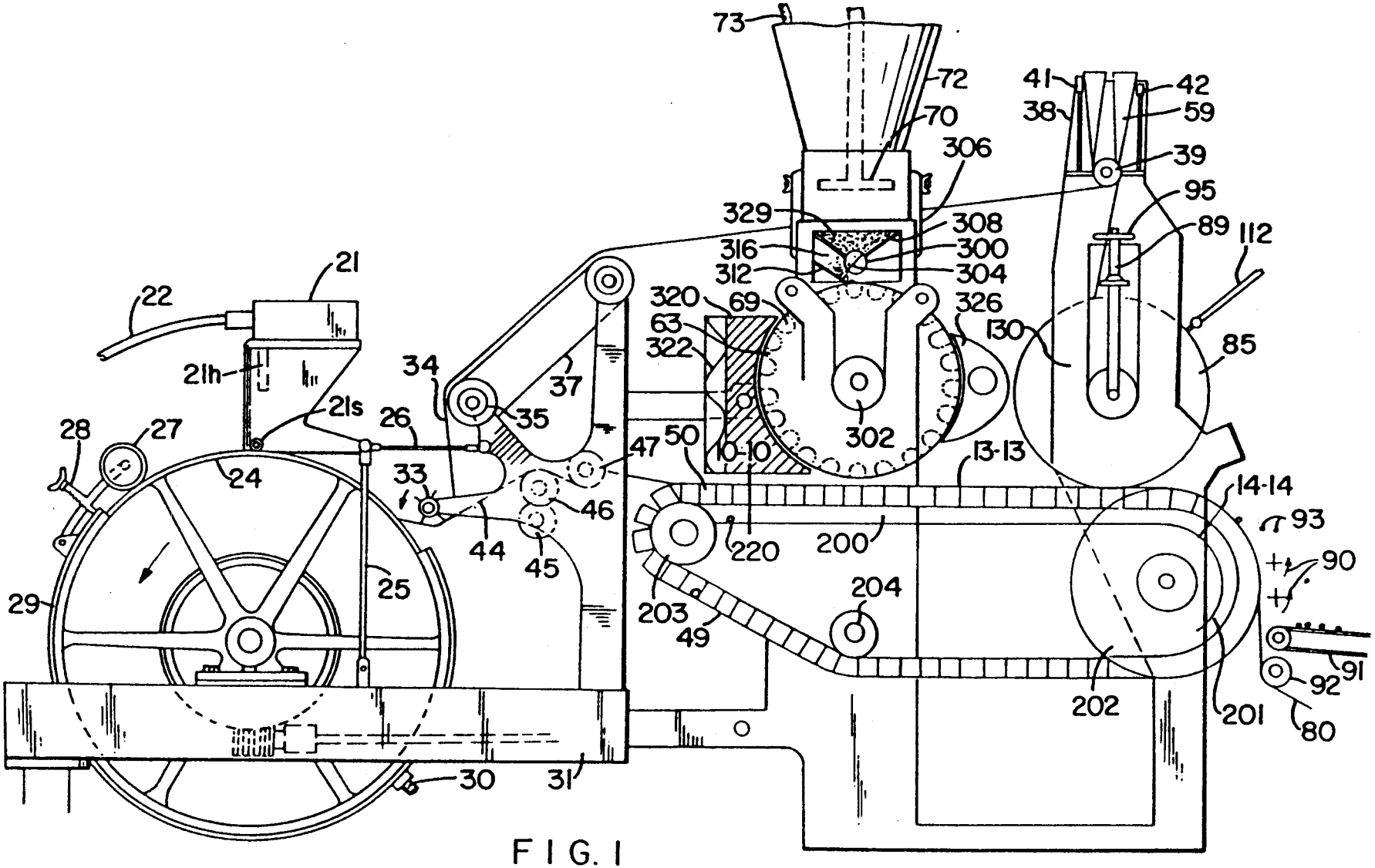
FIG. 1 is a side view of a particular form of an apparatus embodying the present.

Referring to FIG. 1, molten gelatin is prepared and fed into hopper 21. For temperature control it is desirable that the hopper 21 be equipped with a thermostatically controlled heater element 21h so that the gelatin may be kept at a desire temperature. If the hopper is constructed of brass the heat conductivity of the material will enable the heat to be applied at one location, as shown in FIG. 1. If other materials of construction are used a more uniform distribution of heat over its surface may be desirable. A jacketed hopper may also be used with a suitable fluid heat transfer medium. The hopper may optionally be filled by a gelatin supply line 22 connected to a suitable source by which the gelatin in the hopper is maintained at a reasonably uniform level. The gelatin hopper may be equipped with a transparent plastic top or itself be of transparent materials in order that the gelatin level may be observed, but yet maintained free from danger of contamination, and from loss of volatile constituents. The gelatin feeds through the hopper under a doctor blade 23. The gelatin doctor blade 23 may be separate or formed integral with the hopper, which may ride on the surface of the casting wheel 24, which wheel is formed preferably from a metal such as cast iron which should be given a highly polished surface, as for example by chrome plating. The hopper with the attached doctor blade is preferably adjustably locatable by means of links 25 and 26 and adjustable shoes or rollers 21s, riding on the surface of the casting wheel so that the thickness of the gelatin fim may be conveniently regulated. The hopper may be rigid if the doctor blade floats in the desired relationship to the drum surface.

The doctor blade may be divided vertically in the center and each division made independently adjustable so that two separate thicknesses of fim may be cast at the same time. This individual adjustability is of value in adjusting the position of the equatorial seal and in insuring that the wall thickness of the different portions of the capsule will be in accordance with the operator's desires.

The gelatin is split into two portions by a splitting roll 27 which is a reasonably sharp rotatable knife, spring loaded by an adjustable spring mechanism 28 as to separate the cast film into two separate strips. The splitting roll may be located adjacent to the gelatin hopper as shown, or may be located further around the casting wheel. It is only necessary that the gelatin film be somewhat solid at the splitting point, so that the gelatin will not flow back together after being split.

The entire mechanism is best located in an air conditioned room so that both temperature and humidity may be controlled so as to maintain the gelatin film in the desired condition throughout. The casting wheel is covered with shield 29 which is located so that it is adjacent to but does not interfere with the rotation of the wheel. An exhaust duct 30 is provided through which the air is exhausted so that dry conditioned air is pulled in through the casting wheel shield 29 where it dries and conditions the surface of the gelatin film, and is exhausted either into the room or an exhaust duct, depending upon moisture load conditions. The casting wheel is suitably supported from a main frame 31 and driven in suitably timed relationship with the rest of the mechanism by a mechanical drive means (not shown).

The partially dried and conditioned gelatin strip is removed from the casting wheel by a stripper paddle 33. The stripper paddle is driven by a belt or other suitable drive at a faster speed than the peripheral speed of the casting wheel so as to pull of the gelatin film by its actions. The repeated soft blows of the leading edges of this paddle as the paddle is rotated has a tendency to strip the gelatin film without damaging or stretching the film. It is highly advantageous in the production of spherical capsules that the gelatin film not be stretched.

In other embodiments of the present invention where marked stretching of the gelatin film is desirable by keeping it under tension and forming the capsule under tension, a stripping roll may be substituted for the paddle. When so formed, the gelatin strip material attempts to pull back to its original shape to relieve the strain and accordingly, elliptical capsules are produced from round molds. If elliptical shaped capsules are desired, they may be produced in round dies by prestretching the film. Under the normal relationships, where it is desired that a round die cut a round capsule, it is accordingly equally desirable that the gelatin film not be stretched and remain substantially isotropic, so that the finished capsule will retain the desired shape.

Figure 2:
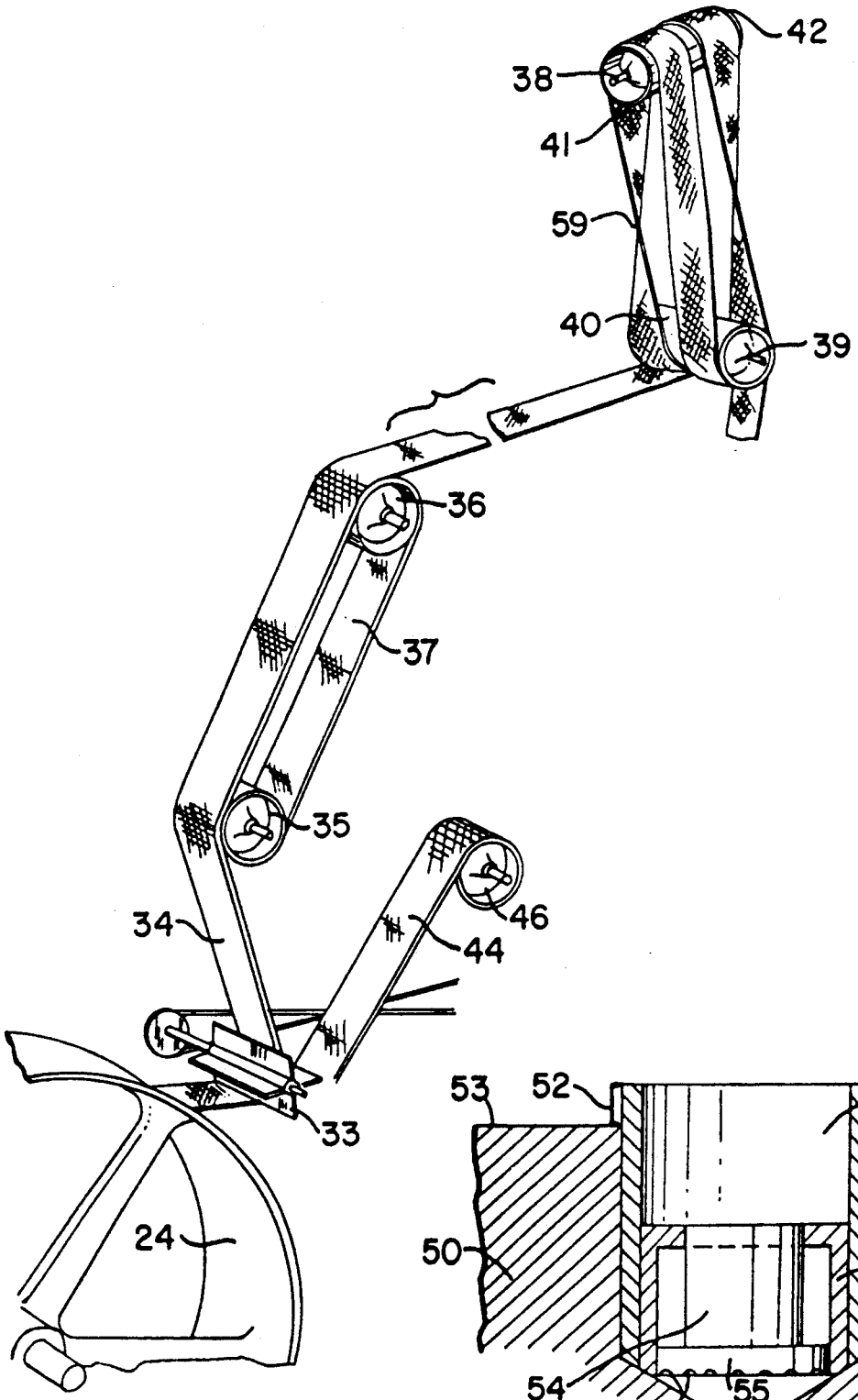
FIG. 2 is a side view showing the paths of the two gelatin strips as they are pulled off the casting wheel.

As shown particularly clearly in FIG. 2, the two gelatin strips take separate paths from the stripper paddle. The sealing film 34 goes above the die roll and may be supported over guide rolls 35 and 36 on which may be placed carrier belt 37. The carrier belt and rollers should be of a material which will not stick to the gelatin. It is possible and frequently convenient to use rolls made from "TEFLON" (polytetrafluoroethylene, see U.S. Pat. No. 2,230,654 (Plunkett)), or from sintered metals which are fed to an oiler to form oiled surfaces to which the gelatin strip will not adhere. If several rollers are used a carrier belt is not necessary.

As shown in FIG. 1, after passing over these guide members the gelatin sealing film strip itself is fed under and over a turnover mechanism 38. It has been found that for the gelatin sealing film to properly adhere to the lower film it is necessary that the casting wheel side of the gelatin sealing film 34 be placed in juxtaposition with the casting wheel side of the lower gelatin film strip 44. The outer face of the strip forms a toughened and hardened surface, apparently from the evaporation of moisture therein, so that it is not nearly as adhesive as the protected side of the strip. The outer tough side seals only with difficulty, and such a seal is more fragile and shows a greater tendency to split.

The turnover mechanism as illustrated in FIG. 2, consists of two suitably journaled rollers 39 and 40 on a shaft parallel to the measuring and sealing roll axes and two suitably journaled rollers 41 and 42 on an axis perpendicular to the previously mentioned axes and thereabove, so that a belt 59 traveling over the pulleys in the order 40, 42, 39 and 41 and back to the 40 will pick up the film, lift the same through 90° to a vertical direction, rotate through 90°, reverse the film into another twist of 90° so that the film is fed out of this turnover mechanism with the casting roll side reversed, and shifted laterally so that this film is now in the same frontal film as is the lower film. The guide rolls 35 and 36 may be driven by any suitable drive system, not shown. Some of the rolls may be driven by travelling belts, as for example the carrier belt 37, or the turnover carrier belt 59. Certain of the rollers may be allowed to be idlers if they are journaled on comparatively friction free bearings so that the gelatin film itself will cause such guide rolls to rotate.

Referring again to FIG. 1, the lower strip of the gelatin 44 is, after being stripped from the casting wheel by the stripper paddle 33, fed over and under guide rolls 46 and 47. Guide roll 46 may be oiled by means of a brush 45, rotating in a shallow bath of oil. Alternately this guide roll may be made of a foraminous material, as for example sintered brass, through which oil is fed from a suitable feed mechanism. It is desirable that a thin film of oil be maintained on the surface of this roll so that the outside surface of the gelatin film is oiled so that it will not adhere as readily to later portions of the apparatus. The guide roll 46 is preferably driven a sprocket drive, not shown, so that the surface speed of the pulley is substantially the same as the surface speed of the casting drum. The roll 47 may be driven from roll 46 by a crossed belt drive, not shown. The lower strip of gelatin 44, then passes to the linked track of cavity blocks 49.

Figure 11:
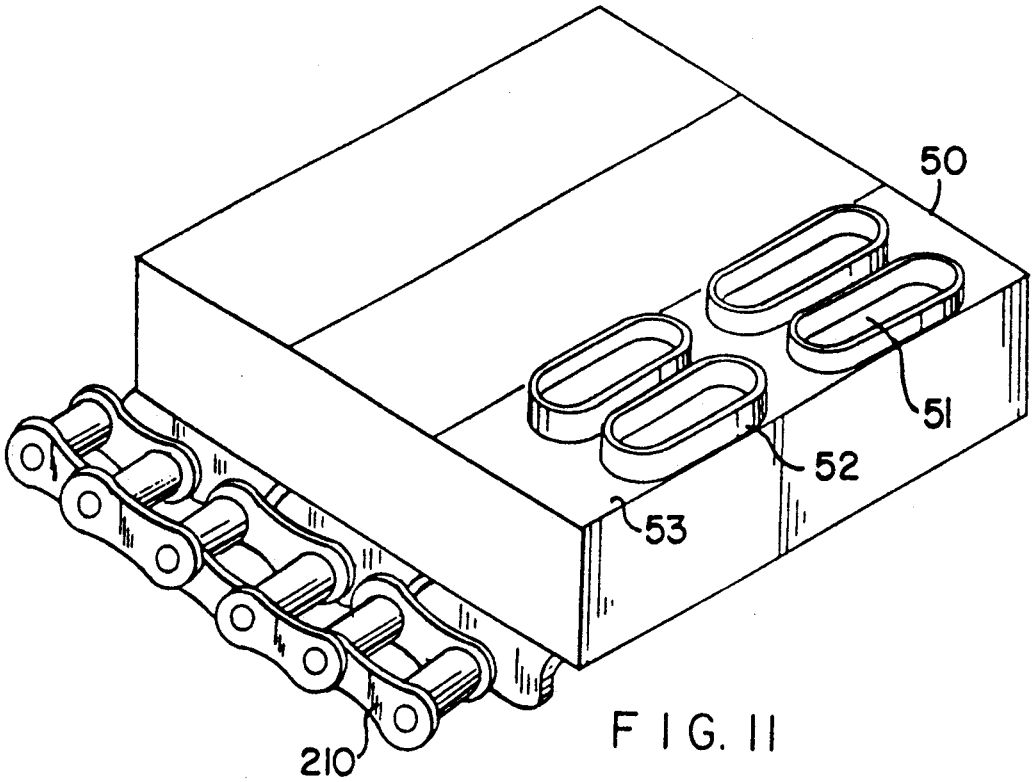
FIG. 11 is an enlarged view of a section of the linked track of cavity blocks and the link chain.

The linked track of cavity blocks 49 is the most important feature of the present invention. Referring to FIG. 11, the linked track of cavity blocks is designed with a plurality of cavity blocks, each cavity block 50 comprising at least one cavity 51 for forming a single gelatin capsule with each rotation of the linked track of cavity blocks 49. The individual capsule charge is placed in this cavity and it is important that the machine work done in forming the cavity blocks be of high order so that the cavities will be of precisely identical dimensions. The consistency of successive charges and the consistency of the size of the filled capsules depends, to a large extend, upon the accuracy of the cavity die blocks. The exact number of cavities in the linked track of cavity blocks is not of critical importance except to the extent it determines the number of capsules filled in each cycle. As shown in FIG. 11, there are two rows of two cavities on each cavity block in the linked track of cavity blocks. A single row or any number of rows however may be used as desired. There may be any desired number of cavities per row on each block as well.

Figure 13:
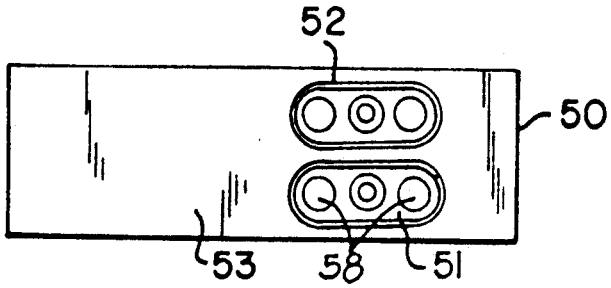
FIG. 13 is an enlarged top view of a single cavity block.

As shown more clearly in FIGS. 11 and 13, each cavity 51, which serves as a filling chamber is preferably cylindrical in nature and has a raised rim 52. The raised rim 52 preferably has a width of approximately one to two times the thickness of the gelatin strip. For small size capsules a width of 0.030 inch has proved satisfactory. The height of this raised rim 52, above the cavity block surface 53 should be at least twice and preferably at least about three times the thickness of the individual gelatin film. The cavity block surface 53 is in general the surface of a horizontal plane but its accuracy is not particularly critical. The surfaces of the raised rim are necessarily very accurate as this raised rim must contact the sealing roll 85 at all positions during the rotation of the sealing roll 85 to give the cut-out of the capsule.

The cavities may be elliptical, hexagonal, square or such other shape as may be desired. The cavity may taper towards the bottom, although no particular advantage is found therein. Such modifications are within the scope of the invention, but are not frequently useful, as the complexity of the machining operations involved usually outweighs the advantages.

Figure 3:
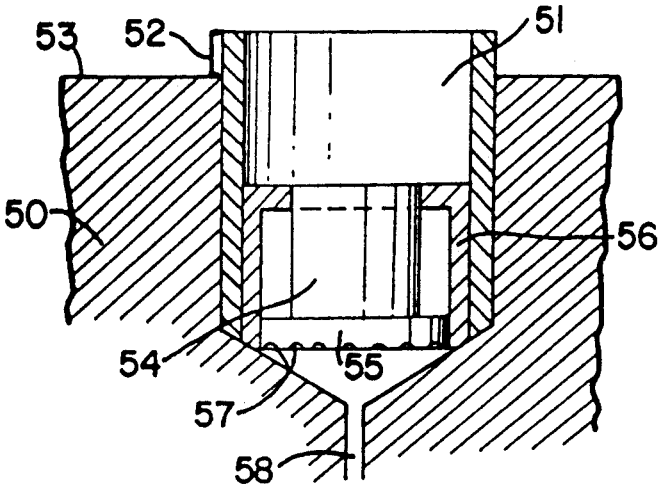
FIG. 3 is an enlarged view of a single die in a cavity block.

Referring now to FIG. 3, each cavity 51 has inserted therein an ejector plug 54. For cylindrical cavities this plug is cylindrical in configuration with a rim 55 thereon. These plugs fit loosely into a plug retainer 56. The plug retainer should fit rather snugly into the cavity so that it will retain its position therein during operations. It may, of course, be held by pins, set screws or other suitable means if desired, but with good machine shop facilities available it is usually cheaper to merely make this plug a press fit. Either the rim of the plug or the bottom of the cavity should be slightly rough or serrated as shown at 57, so that the plug cannot seal tight against the bottom of the cavity. The bottom of the cavity has at least one vacuum port 58 leading from its bottom through the cavity die block to pressure and suction shoes, as later described.

In operation the plug should be of such height that when in its lower position it is substantially even with the upper surface of the plug retainer, so that the filling cavity is a flat bottomed cylinder. The depth of this cylinder determines the depth of the fill for each individual capsule and should be consistent for all of the cavities in the linked track of cavity blocks. This is best obtained by using precise machine operation throughout the construction of the cavity, the ejector plug and ejector plug retainer. There must be sufficient clearance around the edges of the plug so that air from vacuum port 58, can raise the ejector plug until its rim contacts the retainer and is thus held in a raised position by air pressure, and so that air may be evacuated from the cavity during the evacuation portion of the filling cycle. It is desirable but not necessary that the plug come to approximately the top of the cavity when raised by air pressure as it aids in the ejecting of the capsule. The cavity rim may be built up or the rim and the plug retainer made integral and screwed into the surface of the cavity block, or such other construction used as may be more convenient under particular manufacturing conditions, with equipment available.

The individual cavities should be accurately spaced on the cavity block for convenience, as shown in FIG. 11. The cavity blocks should be accurately and firmly linked and hinged to each other. The blocks are attached to a linked chain 210 which moves in an elliptical fashion. The chain, see FIG. 1 is powered by roll 202, and the tension is made adjustable by rolls 203 and 204. Rolls 202 and 203 are configured in such a relation that the linked chain 210 traverses along a horizontal path between them. Underneath the chain along the horizontal path is fitted a vacuum shoe 200. Fitted on the perimeter of roll 202 is air shoe 201.

Figure 12:
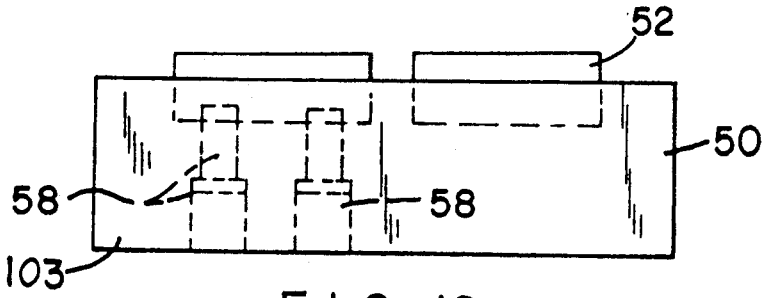
FIG. 12 is an enlarged side view of a single cavity block.

By suitable manifolding means, as for example illustrated in FIG. 12, the inside of the cavity die block 50, has at least one vacuum port 58, preferably two, for each cavity 51 in the cavity die block so that air is evacuated through vacuum port 58 during suitable portions of the filling cycle. Air pressure acts through port 58 during other suitable portions of the cycle.

Figure 14:
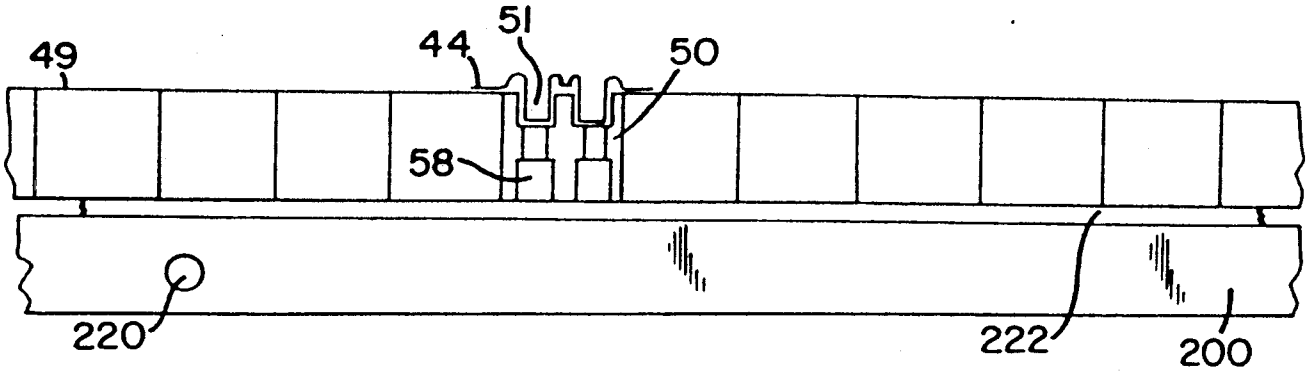
FIG. 14 is an enlarged side view of the linked trackof cvity blocks and vacuum assembly.
Figure 15:
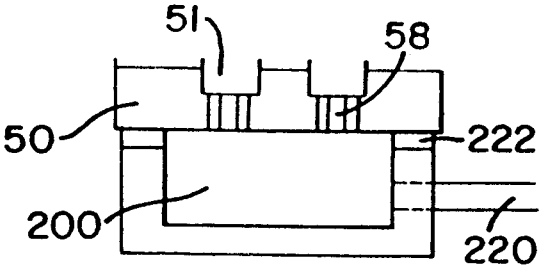
FIG. 15 is an enlarged end view of the vacuum connection of a cavity block.

This is preferably arranged by the vacuum ports 58 having as an integral part thereof a manifolding means such that suction is applied over the desired portion of the filling cycle, i.e. from the point 10—10 to 13—13 as shown in FIG. 1. Referring to FIGS. 14 and 15, vacuum is supplied to the vacuum shoe 200 through vacuum connection 220, and is sealed by a felt strip or a polymeric seal strip 222 which may be made of PTFE or a polyacetal. Thus, as the cavity die blocks 50 pass over the vacuum shoe, suction is applied through the vacuum ports 58 which causes the gelatin film 44 to be pulled in tight against the filling chamber 51 as described more fully herinbelow. Similarly, air pressure is applied through the air shoe 201 in communication with the vacuum ports 58, and supplies pressure so that the ejector plugs 54 are raised at approximately the point 14-14, shown in FIG. 1. The use of multiple air blasts, by manifolding means, is particularly effective in clearing the cavities.

For temperature control of the linked track of cavity blocks 49 it is particularly convenient to install heating members in a stator 103, which may be made of brass. For temperature control it is desirable that the temperature of the stator 103 be controlled, as by a thermostat. Any suitable type of thermostat may be used including either one that is integral and individually adjustable or one in which the thermocouple leads are taken to an outside control. Many variations of temperature control will be obvious to those skilled in the art, and the exact type of thermal control is not an essential feature of the instant invention.

The measuring roll 63, see FIG. 1, operates to fill the capsules with a premeasured amount of filler, such as a powder, liquid or granule material. The measuring roll 63 possesses filling heads 69 on the surface which are space and arranged to function with the die cavities in a timed relationship so that during operation one filling head 69 is directly atop one cavity 51 as the linked track of cavity blocks 49 passes horizontally under the measuring roll 63.

Figure 4:
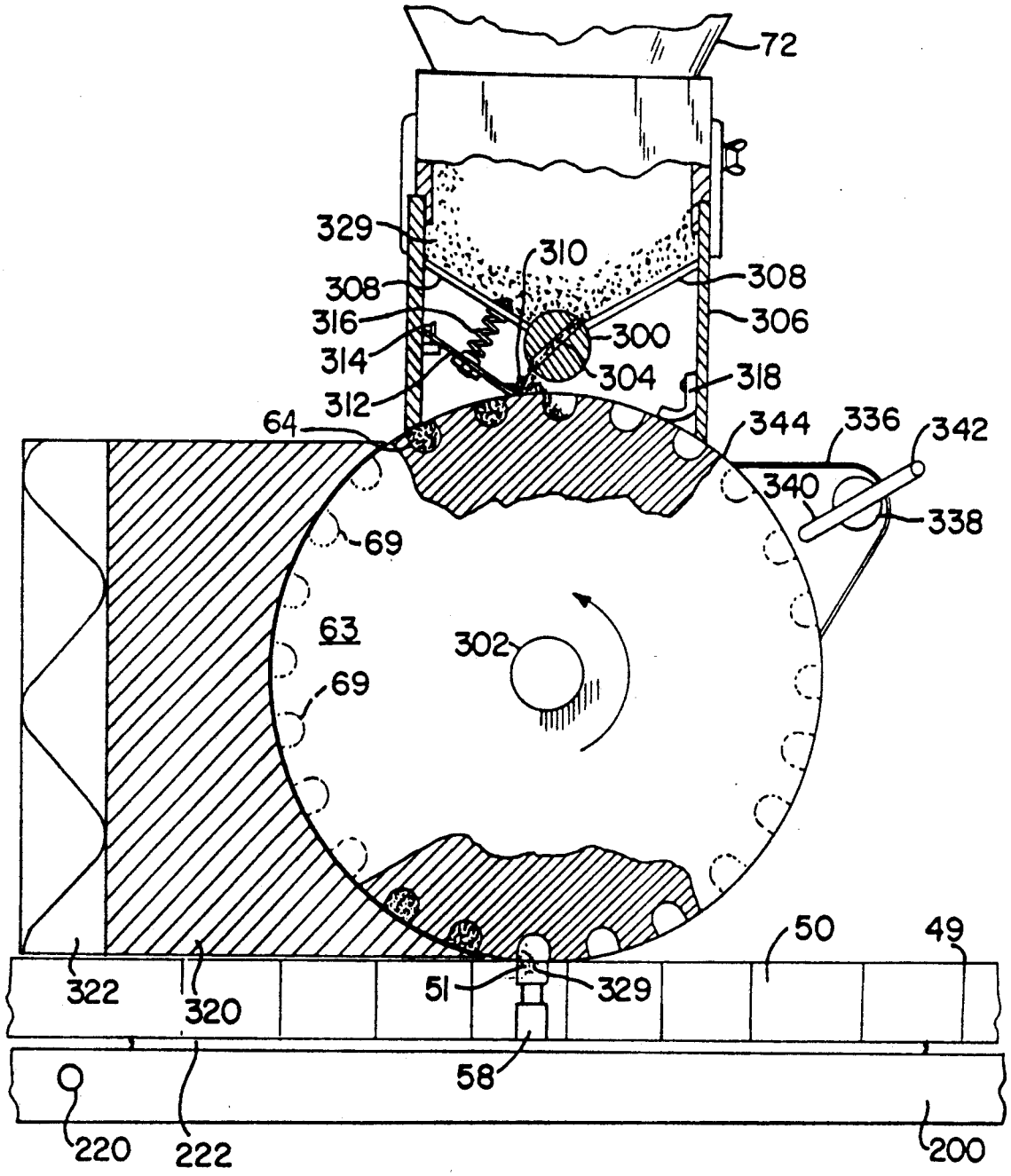
FIG. 4 is an enlarged view of the hopper, measuring roll and charge retaining block.

The individual filling heads 69 are shown in FIG. 4. Each of them consists of a cylinder 61. During the fill operation, a filling head 69 rotates down into juxtaposition with the gelatin film riding on the linked track of cavity blocks 49. The exterior diameter of the filling head 69 should be such that there is sufficient clearance between it and the cylindrical surface of the cavity for the thickest gelatin film to be employed with the machine.

A plurality of these filling heads 69 are positioned on the measuring roll 63 so that each cavity 51 on the cavity die block 50 has a corresponding filler head 69 on the measuring roll 63.

It is contemplated that measuring roll 63 may be equipped with a filling head heater element and a filler block thermostat, (both not shown). As mentioned, elsewhere, any of the conventional types of heaters and thermostats may be used. Electrical control is particularly convenient. Heating of the block is not always necessary but it is particularly convenient, when the machine is used for hygroscopic powders, as it keeps the block warm so that moisture will not cause the powder to cake while in the filler heads 69.

The measuring roll 63 has mounted thereon a powder hopper 72. The powder hopper 72 is preferably made of a transparent material so that its contents may be readily observed. As shown in FIG. 1, the powder hopper has a stirrer 70 mounted therein which consists of wires mounted on a shaft which is mounted in the top of powder hopper 72 and is turned by a flexible shaft 71 driven by a suitable powder source. It is desirable that the stirrer by rotated sufficiently rapidly to avoid caking or bridging of the powder. If desired the powder hopper 72 may be provided with a feed opening 73 in which a flexible duct carrying additional powder may be inserted so that the powder 72 may be filled automatically or manually as may be desired with additional powder during operation of the machine so that the powder hopper 72 is maintained sufficiently filled for constant operation without shutdown. For satisfactory results it is necessary that sufficient powder be maintained in the powder hopper 72 at all times so that no filling head 69 draws air instead of powder from the hopper.

Preferably, referring to FIGS. 1 and 4, inside the hopper 72 and rotatably mounted in the front and rear of the hopper 72 is a slotted flow control valve 300. The slotted flow control valve 300 is parallel to the measuring roll axle 302 and is mounted so that it can be turned about its axis. The slotted flow control valve 300 is a round shaft through which passes a slot 304. Extending from adjacent the slotted flow control valve 300 to the vertical hopper sides 306 is the sloped hopper bottom 308 which forms a seal with the slotted flow control valve 300 so that material in the hopper 72 is fed towards the slotted flow control valve 300, and the position of the slot 304 in the slotted flow control valve 300 may be adjusted by turning so that the rate of feed of material in the hopper 72 is readily controlled. The slot 304 may be turned so as to be partially obstructed by the sloped hopper bottom 308 to control the feed rate, and may be turned to completely shut off the flow.

The slotted flow control valve 300 is close to, but does not touch, the measuring roll 63. Material flows down through the slot 304 until a small pile of material 310 is built up on the measuring roll 63, at which time the pile 310 blocks the flow of additional material through slot 304.

Under the sloped hopper bottom 308, in the direction of measuring roll rotation, is a material doctor 312. The material doctor 312 is mounted on a doctor support pin 314, so that the doctor 312 is free to move about the pin 314 on all three axes. The doctor is pressed against the measuring roll 63 by a doctor spring 316. The doctor spring 316 permits the doctor 312 to twist slightly to compensate for any lack of uniformity in the cylindrical surface of the measuring roll 63, and hold the doctor 312 in sliding contact with the measuring roll 63 at all times. Because the doctor 312 is mounted with a spring 316, the doctor 312 will slide on the measuring roll surface without leaving crevices, and only a very small amount of material is caught between the edges of the filling heads 69 and the doctor 312, thus forming filled filling heads 64.

At the side of the hopper 72, toward which the measuring roll rotates, is a felt wiper 318. The wiper 318 wipes material or dust particles from the surface of the measuring roll 63 and serves as an additional seal against the escape of material backwards.

Fastened to the side of the hopper 72 in the direction of roll rotation is a charge retaining block 320. The portion of the charge retaining block 320 closest to the measuring roll 63 has the same curvature as the surface of the measuring roll 63, and is positioned to rest closely against the surface of the measuring roll 63. The charge retaining block 220 is held against the measuring roll 63 by spring tension block 322. The spring tension block 322 has mounted therein an adjustable spring 324 which may be adjusted to control the firmness with which the charge retaining block 320 is drawn against the measuring roll 63. The charge retaining block 320 is preferably adjusted tight enough to prevent loss of fill material, but is loose enough to reduce friction. The end of the charge retaining block 320 is close to the line of centers between the measuring roll 63 and the corresponding cavity block 50. Thus, the fill material is held in the filling heads 69 until close to the point of closest approach between the measuring roll 63 and corresponding cavity die block 50, and is then dropped from the filling heads 69 into a mated corresponding cavity 51 in the lower gelatin strip 44. The capacity of the filling heads 69 is such that a desired quantity of material is dropped into each cavity 51. The configuration of the filling heads 69 is such that the material 329 falls directly into a cup-shaped cavity 51 without any material spilling onto the surface of the lower gelatin 44 which stretches between the rims of the cavity die inserts.

On the side of the measuring roll 63 away from the charge retaining block 320, and which during filling operations has empty filling heads 69 is a vacuum shoe 326. The vacuum shoe 326 extends down to adjacent the measuring roll 63. A vacuum line 338 conducts air from within the vacuum shoe 326 to a dust collector and vacuum source (not shown). Inside the vacuum shoe 326 is an air lance 340. The air lance 340 consists of two sheets of metal with a fine slit between them, which slit is directed against the surface of the measuring roll 63. Compressed air from an air line 342 is directed through the air lance 340 against the surface of the measuring roll 63, which thus displaces any particles of dust or material which may have adhered to the surface of the measuring roll 63, or have become stuck in the measuring chambers 64. An inspection gap 344 between the vacuum shoe 326 and vertical hopper side 306 permits inspection of the measuring roll 63 to be sure that all particles are removed.

Figure 5:
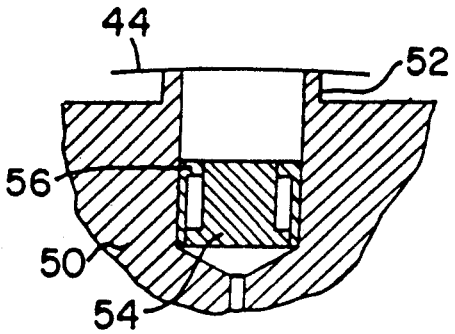
FIG. 5 is an enlarged view of a cavity at point 10—10, prior to filling.
Figure 6:
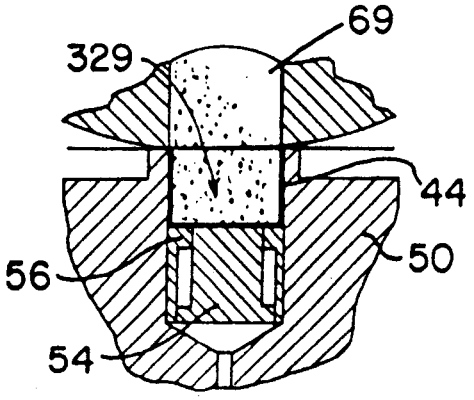
FIG. 6 is an enlarged view of a cavity during filling.

Referring to FIG. 1, the lower gelatin strip 44 is fed under the guide roll 47 and into contact with the linked track of cavity blocks 49. The gelatin strip is positioned on the linked track of cavity blocks 49 resting on top of the raised rims 52. At the point shown by line 10—10, the vacuum shoe 200 admits suction to each cavity through the vacuum ports 58 which causes the gelatin film to be pulled tight against the raised rim 52 and drawn therein to form a cup shaped lining in the filling chamber 51. FIG. 5 shows the lower gelatin strip 44 positioned on the raised rim 52 and FIG. 6 shows the film 44 having been pulled down into contact with the ejector plug 54 and plug retainer 56. The suction is maintained on the chamber until after the capsule is sealed and cut out.

As the gelatin lined chamber advances it comes into contact with measuring roll 63, shown schematically in FIG. 6. The filling head 69 may enter partially into the gelatin lined container. The filling head 69 itself preferably rests on the gelatin film.

At this portion of the cycle the filling occurs. It has been found that homogeneous powders will normally be compacted by such an arrangement so that the density of a charge will not ordinarily vary more than a fraction of one percent. If the charge chambers are of consistent size and the gelatin film is cast to a constant thickness, this will mean that the individual chambers will be filled uniformly so that the final capsules contain equal dosages.

After the filling operation is completed, the filled cavities traverse horizontally along the linked track of cavity blocks 49 and encounter the sealing roller 85, as shown in FIG. 1, at which point the sealing film 34 is brought into juxtaposition with the filled cavities. The sealing roller 85 is spring mounted by a sealing roll spring assembly 89 so that the pressure between it and the linked track of cavity blocks may be readily varied by know 95 and so that any irregularities may be compensated by spring action.

Figure 7:
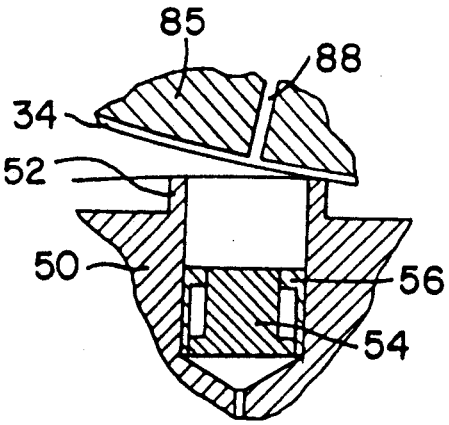
FIG. 7 is an enlarged view of a cavity at point 13—13, after filing but prior to sealing.
Figure 9:
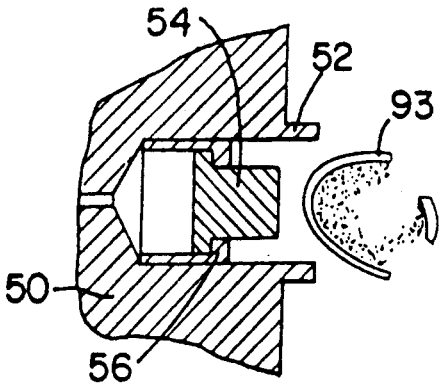
FIG. 9 is an enlarged view of a cavity at point 14—14 during ejection.
Figure 8:
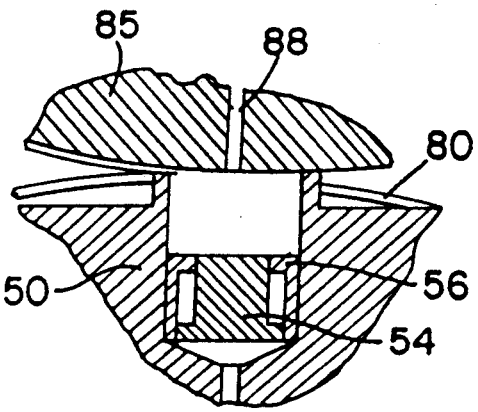
FIG. 8 is an enlarged of a cavity during sealing.

As shown in FIGS. 7 and 8, the sealing roll 85 may have small apertures 88 therein, conveniently though not necessarily mated to match with the cavities in the die blocks, through which vacuum is applied as by the manifold 111 and the vacuum connection 100 (See FIG. 9). The suction through these orifices assists in positioning the sealing film so that it will not slide unduly on the surface of the sealing roll. If the particular gelatin compound used appears to stick to the sealing roll, an air pressure assembly, such as is used in the linked track of cavity blocks, may be embodied in the sealing roll to assist in releasing the gelatin film and capsules from the sealing roll. As shown in FIG. 1, an oil fed wick 112 may rest upon the surface of the sealing roll, being in turn supplied by a suitable oil supply so that a thin film oil is maintained on the surface of the sealing roll at all times to prevent adherence of the gelatin film to the sealing roll. It will be found that if the roll is overheated the gelatin is particularly apt to stick, and that if a gelatin mixture requires a higher temperature, particular care is necessary to insure that the sealing roll has a high gloss and is adequately oiled to prevent sticking or building up of gelatin on the surface.

As more particularly shown in FIG. 10, a heater member 86 is in contact with the sealing roll stator 113, and is thermostatically controlled by means of a thermostat 87 so that the temperature of this roll my be maintained as desired. Where as the thermostat and heater are shown in a stator, they may be built as sliding upon the side surface of the sealing roll or the heater and thermostat may be built integral with the sealing roll and connections may be made by sliding contacts brought out through the axle if desired. The stator 113 is retained in position by the sealing roll stator positioning pin 129 which is attached to sealing roll bracket 130 (FIG. 1). The temperature adjustment of the sealing roll may be critical as will be later described.

As the cavity blocks traverse under the rotating sealing roll 85, the above described spring action first causes the sealing film 34 to contact the lower strip 44 and then to press upon the lower strip which in turn is supported by the raised rim 52, until the raised rim cuts into the combined gelatin films as shown in FIG. 8. The compression action caused by this pressure causes the gelatin caught between the raised rim and sealing roll to be extruded and as it is pressed between these members it unites with itself so that a sealed joint is formed. The two gelatin films under proper operating conditions are so uniformly united that it requires inspection to locate the seal and the seal is nearly as strong as the wall of the capsule. The residual web 80, is forced down on the outside of the raised rim and into space provided therein. As the blocks and sealing separate, air pressure is applied by means of an airshoe 201 located under the linked tracked of cavity blocks 49 and around roll 202 so as to raise the ejector plug 54 as shown in FIG. 9. This action of raising the ejector plug 54 causes the filled capsule 93 to be pressed out of the chamber and allows it to spring to its natural shape.

To give a good clean seal and to cut the gelatin completely out of the web it is desirable that the sealing spring assembly 89 press comparatively firmly upon the surface of the sealing roll 95. If there are any irregularities in the rim, a small flash may remain which may cause the capsule to stick in the web, but under normal operating conditions, if the rolls are accurately made, the capsules will be completely detached. As shown in FIG. 10, the capsules have a tendency to be ejected by the ejector plug 54 and the air pressure. This is followed by the action of two revolving brushes 90, as shown in FIGS. 1 and 10, which rotate in a counter-clockwise direction as a comparatively high rate of speed; their peripheral speed being several times the surface speed of the linked track of cavity blocks. These brushes have an additional tendency to throw capsules upon a conveyor belt 91 which removes the capsules to a discharge point. The web with the capsules cut out thereof is pulled around the web roller 92 and through the web removal rollers, not shown, which rollers are rotated at a slightly higher surface speed so as to pull the web and stretch it so that it is easily removed. The web from this point is fed to a waste container or otherwise disposed of. Other means may be used to remove the residual web, and frequently just gravity is adequate. Individual suction cups, brushes and other methods shown in the prior art may be used.

The sealing roll spring assembly 89 may be any conventional universal assembly where the spring loaded sealing roll 85 is permitted to run in contact with the gelatin contacting the linked track of cavity blocks. It is desirable that both the temperature and the humidity of the room or area in which the apparatus is operated be controlled. Whereas the exact temperature and humidity at practically every point of operations may be varied over a rather wide temperature and humidity range and still give satisfactory results, the relative relations for a particular operation are comparatively critical, and for any given run should remain reasonably constant. For example, the proportion of water in the gelatin film may be decreased as the temperature is raised. A higher temperature may be used for the casting roll and throughout if less glycerine is used. A longer drying time is required at lower temperatures or if the relative temperature between the linked track of cavity blocks 49 and the sealing roll 85 is extremely important in adjusting the position of the sealing line. For example, warmer gelatin flows more readily than cold. The temperature of the cavity blocks is controlled by thermostatic means from a thermostat, diagrammatically illustrated as 102, which controls the heat supply to the stator 103. The heater element may lie in or on the cavity block and may be an electrical resistance element or other source of thermal energy as shown at 107. The amount of energy being supplied must be under rather adequate and rapid control to insure proper temperature relations. As set forth in certain of the specific examples, if the cavity die block is kept at a slightly lower temperature than the sealing roll, the gelatin strips in contact with each will be at those respective temperatures. When sealed together the portions contacting the walls and bottom of the cavity will be cooler than the portion constituting the top. When released the hot portion will stretch more easily. The cooler portions will tend to shrink. As the capsule assumes its normal rounded shape, the cooler portion of the gelatin, by attempting to shrink to its original dimensions, will stretch the portion constituting the top and because this portion is warmer it will stretch more readily, and if the relative temperatures are properly adjusted, the line of seal will be equatorially located on the capsule. It is not necessary that this sealing be equatorial and by temperature adjustment the line of seal may be adjusted as desired. The equatorial seal is suggested as the type of seal which in the past has most readily been met with consumer acceptance.

The guide rollers, oil rolls, turnover rolls, etc. are normally permitted to remain at room temperature or at such temperature as they assume from their contact with the gelatin film and no temperature control is necessary. However, for certain operative conditions, as for example, where it is desired to use a lower water content in the gelatin film so as to give a more rapid drying in the final capsule, it may be desire that these rollers in a turn be temperature controlled. The casting wheel roller is normally permitted to assume its natural temperature. As the average gelatin fluid flows upon it the gelatin film will be somewhat cooled and will solidify rather rapidly but then as the moisture begins to evaporate from the surface of the film it will tend to cool the wheel below room temperature and by the time gelatin film leaves the casting wheel it may be below room temperature. If extremely stable or fast setting gelatin film is used it may be desirable to warm the casting wheel so as to cause more rapid evaporation of the moisture and thus permit faster operation of the apparatus. Additional speed may be obtained from some gelatins by using warmer air to set the film.

It is contemplated that the filling material be a liquid rather than a solid powder. In such an embodiment the measuring roll is replaced with a means for measuring a liquid filler into the capsule. Conveniently this may comprise a nozzle or a dripper although any conventional apparatus known to those skilled in the art may be employed.

The above mentioned patents and publications are incorporated herein by reference.

Many variations of the present invention will suggest themselves to those skilled in this art in light of the above detailed description. For example, instead of a powder, a granule substance may be employed as the filler in the measuring roll. Likewise, a paste may be employed instead of a liquid. Instead of a gelatin, it is further contemplated to use a soft plastic as the capsule forming material. All such obvious modifications are within the scope of the present invention.

We claim:

1. An apparatus for producing soft plastic or gelatinous capsules filled with a powder, granule, liquid or paste composition comprising:

(i) a linked track of cavity blocks, each said block comprising at least one cavity for forming said capsules;

(ii) a frame or base supporting in sequence (a) a means for feeding a strip of soft plastic or gelatinous material onto said linked track of cavity blocks comprising a frame or base supporting (A) a casting wheel for receiving a molten soft plastic or gelatinous material from a soft or gelatinous material source located above the casting wheel; (B) a doctor blade riding on the surface of the casting wheel for regulating the thickness of the film of soft plastic or gelatinous material downwheel of said material source; (C) a splitting roll comprising a reasonably sharp rotatable knife for cutting said film into two film strips downwheel of said doctor blade; and (D) a stripper paddle for removing a first film strip to said linked track of cavity blacks and for removing a second film strip and feeding second film strip to a sealing means;

(b) a vacuum means for continuously causing said first strip of soft plastic or gelatinous material to be pulled in tight against the walls of the capsule forming cavities during a filling step and a seating step comprising a vacuum hose located underneath and in continuous sealed communication with the linked track of cavity blocks along a horizontal path;

(c) a means for filling said cavities with said powder, granule, liquid or paste composition;

(d) a means for sealing the filled cavities with a soft plastic or gelatinous material; and (e) an ejection means for removing the sealed filled capsules from said linked track of cavity blocks; and (iii) a means for driving said linked track of cavity blocks in an elliptical fashion past said feeding means, vacuum means, filling means, and ejection means; where said linked track of cavity blocks is on a horizontal plane during the filling and sealing of the capsules.

2. An apparatus as defined in claim 1 wherein said powder, granule or liquid composition comprises a pharmaceutical or a vitamin.

3. An apparatus as defined in claim 1 wherein said cavity blocks each contain 4 cavities for forming capsules.

4. An apparatus as defined in claim 1 wherein said cavities for forming said capsules are spherical, elliptical, hexagonal or square in shape.

5. An apparatus as defined in claim 1 wherein said feeding means comprising a casting wheel, a doctor blade, a rotatable knife for splitting the soft plastic or gelatinous material into two strips and a stripping paddle, whereby one strip is fed to said linked track of cavity blocks and the second strip is fed to said sealing means.

6. An apparatus as defined in claim 1 wherein said filling means comprises a measuring roll having a curved lower surface adapted to fit against and match the portion of the cavity block containing the cavity or cavities with a filling head or heads, adapted to contain a flowable powder or granule composition, said measuring roll being timed to rotate in coordination with said linked track of cavity blocks to coordinate contact of said cavity or cavities with said filling head or heads.

7. An apparatus as defined in claim 1 wherein said filling means comprises a means for delivering a metered amount of liquid or paste to said cavity or cavities.

8. An apparatus as defined in claim 1 wherein said sealing means comprising a sealing roll.

9. An apparatus as defined in claim 1 wherein said ejection means comprises an airshoe located downbelt of said sealing means and which is in communication with said cavity blocks.

10. In a method for filling a flowable powder or granule composition into soft plastic or gelatin capsule shells which comprises continuously moving a continuous plastic strip having a plurality of capsule shells formed therein, filling a group of flowable powder or granular sources in a filler head block adjacent to a moving group of said capsule shells, one said source for each said shell, with said filler head block resting on said plastic strip which itself forms a resilient part of a seal until each of said shells is filled with said powder or granule composition, and removing said group of flowable powder or granular sources, the improvement consisting of continuously forming the capsule shells in the plastic strip by applying vacuum suction in continuous sealed communication to a manifold in the cavity blocks as the cavity blocks continuously traverse along a horizontal path during the filling and sealing steps and carrying out said filling of a flowable powder or granule composition into the soft plastic or gelatin capsule shells on a flat-horizontal track of linked cavity blocks whereby the amount of spilled powder or granule composition is decreased.

11. The method of claim 10 wherein said composition comprises a liquid or a paste.

12. An apparatus for producing soft plastic or gelatinous capsules filled with a powder, granule, liquid or paste composition comprising:

(i) a linked track of cavity blocks, each said block comprising at least one cavity for forming said capsules;

(ii) a frame or base supporting in sequence (a) a means for feeding a strip of soft plastic or gelatinous material onto said linked track of cavity blocks comprising a frame or base supporting (A) a casting wheel for receiving a molten soft plastic or gelatinous material from a soft or gelatinous material source located above the casting wheel; (B) a doctor blade riding on the surface of the casting wheel for regulating the thickness of the film of soft plastic or gelatinous material downwheel of said material source; (C) a splitting roll comprising a reasonably sharp rotatable knife for cutting said film into two film strips downwheel of said doctor blade; and (D) a stripper paddle for removing a first film strip to said linked track of cavity blocks and for removing a second film strip and feeding said second film strip to a sealing means;

(b) a means for filling said cavities with said powder, granule, liquid or paste composition;

(c) a means for sealing the filled cavities with said second film strip;

(d) an ejection means for removing the sealed filled capsules from said linked track of cavity blocks;

(iii) a means for driving said linked track of cavity blocks in an elliptical fashion past said feeding means, filling means and ejection means where said linked track of cavity blocks is on a horizontal plane during the filling and sealing of the capsules; and (iv) a vacuum means for continuously causing said first strip to be pulled in tight against the walls of the capsule forming cavities during filling and sealing of the capsules comprising a vacuum shoe located underneath and in sealed communication with the horizontal plane of cavity blocks.

* * * * *